US006857528B2

(12) United States Patent
Klein et al.

(10) Patent No.: US 6,857,528 B2
(45) Date of Patent: Feb. 22, 2005

(54) OVER DOOR STORAGE RACK FOR BASE CABINET DOORS

(75) Inventors: Richard B. Klein, Overland Park, KS (US); John W. Scott, Lenexa, KS (US); Chris Serslev, Leawood, KS (US)

(73) Assignee: Lynk, Inc., Lenexa, KS (US)

( * ) Notice: Subject to any disclaimer, the term of this patent is extended or adjusted under 35 U.S.C. 154(b) by 53 days.

(21) Appl. No.: 10/279,474

(22) Filed: Oct. 24, 2002

(65) Prior Publication Data

US 2004/0079717 A1 Apr. 29, 2004

(51) Int. Cl.[7] ..... A47F 5/00

(52) U.S. Cl. ..... 211/119.004; 211/105.1; 211/86.01; 248/214

(58) Field of Search ..... 211/119.004, 105.1, 211/87.01, 86.01, 88.01, 106, 118; 248/214, 215

(56) References Cited

U.S. PATENT DOCUMENTS

| | | | | |
|---|---|---|---|---|
| 2,305,863 | A | * 12/1942 | Ginter | |
| 2,459,909 | A | 1/1949 | Alofs | |
| 2,925,916 | A | * 2/1960 | Pollock | 211/86.01 |
| 3,162,414 | A | * 12/1964 | Maschek | |
| 3,918,670 | A | 11/1975 | Doherty | |
| 4,425,012 | A | * 1/1984 | Kley | |
| D287,550 | S | 1/1987 | Tocci | |
| D354,412 | S | 1/1995 | Emery | |
| 5,570,642 | A | * 11/1996 | Lehrman | 248/214 X |
| D381,225 | S | 7/1997 | Malik | |
| 5,645,178 | A | * 7/1997 | Conley | 211/87.01 |
| D385,481 | S | 10/1997 | Klein et al. | |
| D386,668 | S | 11/1997 | Klein et al. | |
| D397,565 | S | 9/1998 | Klein et al. | |
| 5,855,279 | A | 1/1999 | Klein et al. | |
| 5,875,902 | A | * 3/1999 | Emery et al. | 211/106 X |
| 6,152,313 | A | 11/2000 | Klein et al. | |
| 6,223,914 | B1 | * 5/2001 | Snell | 211/119.004 |
| 6,488,241 | B1 | * 12/2002 | Kyte et al. | |
| D483,249 | S | * 12/2003 | Klein et al. | D8/373 |
| D483,250 | S | * 12/2003 | Klein et al. | D8/373 |

* cited by examiner

*Primary Examiner*—Robert W. Gibson, Jr.
(74) *Attorney, Agent, or Firm*—Shook, Hardy & Bacon L.L.P.

(57) ABSTRACT

A storage rack which hangs on the upper edge of a base cabinet door. A pair of hanger brackets fit closely on the door edge and are constructed to accommodate the plain edge of a flush mounted door or the stepped edge of a recessed cabinet door. Hooks on the inside parts of the brackets receive mounting fixtures used to attach storage devices such as baskets, trays, shelves, paper towel holders, food wrap dispensers, towel hooks or towel bars. Tabs on the outside parts of the hanger brackets allow a towel bar or other device to be mounted on the outside surface of the base cabinet door.

20 Claims, 4 Drawing Sheets

OVER DOOR STORAGE RACK FOR BASE CABINET DOORS

FIELD OF THE INVENTION

This invention relates generally to the storage of household articles on cabinet doors and more particularly to a storage rack that hangs on the door of a base cabinet of the type commonly found in residential kitchens beneath counters and in other areas such as laundry rooms, bathrooms, garages and basement storage areas.

BACKGROUND OF THE INVENTION

Base cabinets in kitchens are commonly used for the storage of food and various household products such as dish towels, bags, soaps, paper towels, food wrap, and cleaning supplies. Other household areas such as bathrooms, basements, laundry rooms and garages are also often provided with base cabinets. Because of the variety of items that are typically stored in base cabinets, it is common for the cabinets to become cluttered and disorganized. The hinged doors that open and close base cabinets are used at times to hold racks which are permanently fixed to the inside door surface. However, the use of space is not efficient in this type of arrangement. Further, the need to mount a storage rack permanently with fasteners such as screws results in permanent marring of the door surface.

BRIEF SUMMARY OF THE INVENTION

The present invention is directed to a storage rack that hangs on the top edge of a base cabinet door and provides for the storage of various articles, including dish towels, dish rags, bags, food wrap, cleaning supplies, dish soap, paper towels and other household articles that can be stored in a basket or tray or on a shelf in a kitchen or other area. Preferably, the storage rack hanging system includes a structure for mounting a towel bar on the outside surface of the base cabinet door. Additionally, the hanger brackets for the storage rack are preferably provided in two different configurations, one for a flush mounted cabinet door and the other for a recessed door.

It is an object of the invention to provide a base cabinet storage rack that hangs securely on the upper edge of a base cabinet door to accommodate storage of various articles commonly stored in base cabinets. It is a particular feature of the invention in this regard that the storage device can take a number of different forms, including a towel bar, hooks, a basket, a shelf, a tray, a bag holder, a paper towel holder, a food rack dispenser, or another type of storage apparatus.

Another object of the invention is to provide a base cabinet storage rack of the character described that may be constructed to accommodate a towel bar on the outside surface of the cabinet door and a storage device for other items on the inside surface of the door.

A further object of the invention is to provide a base cabinet storage device of the character described that is applicable both to flush mounted doors and to recessed doors. In this respect, the hanger bracket that hangs on the top edge of the cabinet door can have an inverted U-shape to fit closely on a flush door edge, or it can have a stepped configuration to fit closely on the stepped upper edge of a recessed door. Alternatively, a single bracket can be constructed in a manner to accommodate both types of doors in different orientations.

Yet another object of the invention is to provide a base cabinet storage rack of the character described that is constructed to accommodate the storage of a wide variety of household articles.

A still further object of the invention is to provide a base cabinet storage rack of the character described that can be detachably mounted on a cabinet door without permanently damaging any part of the door.

An additional object of the invention is to provide a base cabinet storage rack of the character described that is constructed in a simple and economical manner, has an aesthetically pleasing appearance, and can be packaged compactly and assembled easily without the need for special skills or tools.

These and other objects of the invention are achieved by providing special hanger brackets that hang closely and securely on the upper edge of a base cabinet door. Each bracket may have a leg extending downwardly along the inside door surface. A hook or other structure may be formed on the lower end of each leg to receive a mounting fixture to which a basket or other storage device may be attached.

The brackets preferably also present tabs or another structure on the outside of the door for the receipt of mounting fixtures for a towel bar. The towel bar fits in sockets in the mounting fixtures to extend between them, thus mounting the towel bar at a convenient location on the outside of the door.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
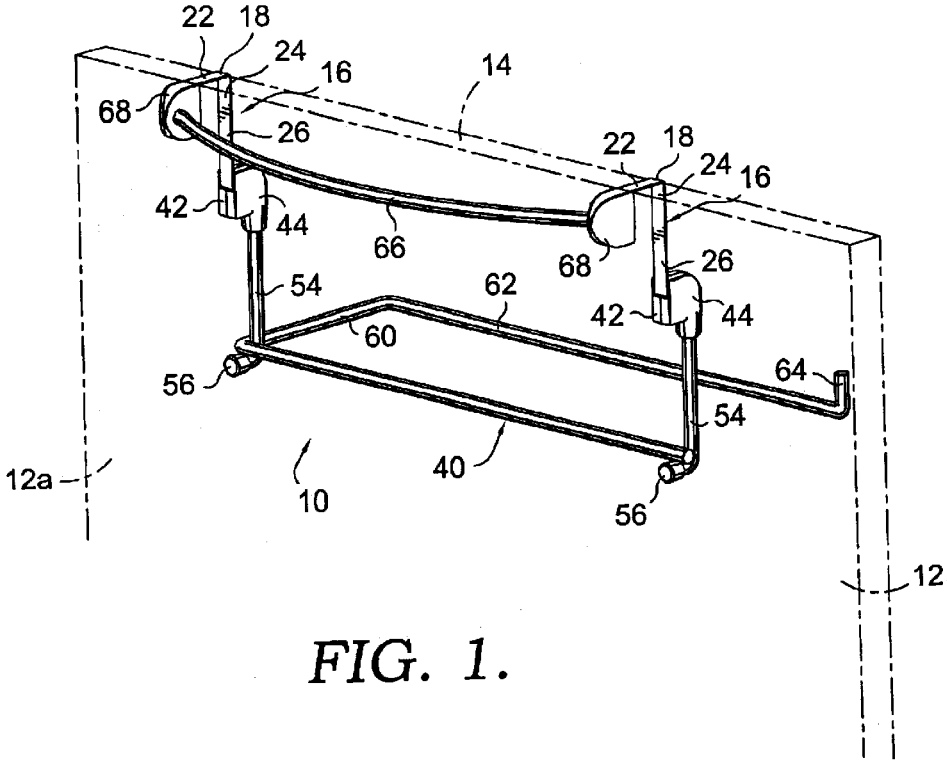
FIG. 1 is a perspective view of a storage rack constructed according to one embodiment of the present invention applied to a flush mounted base cabinet door which is shown in broken lines.
Figure 7:
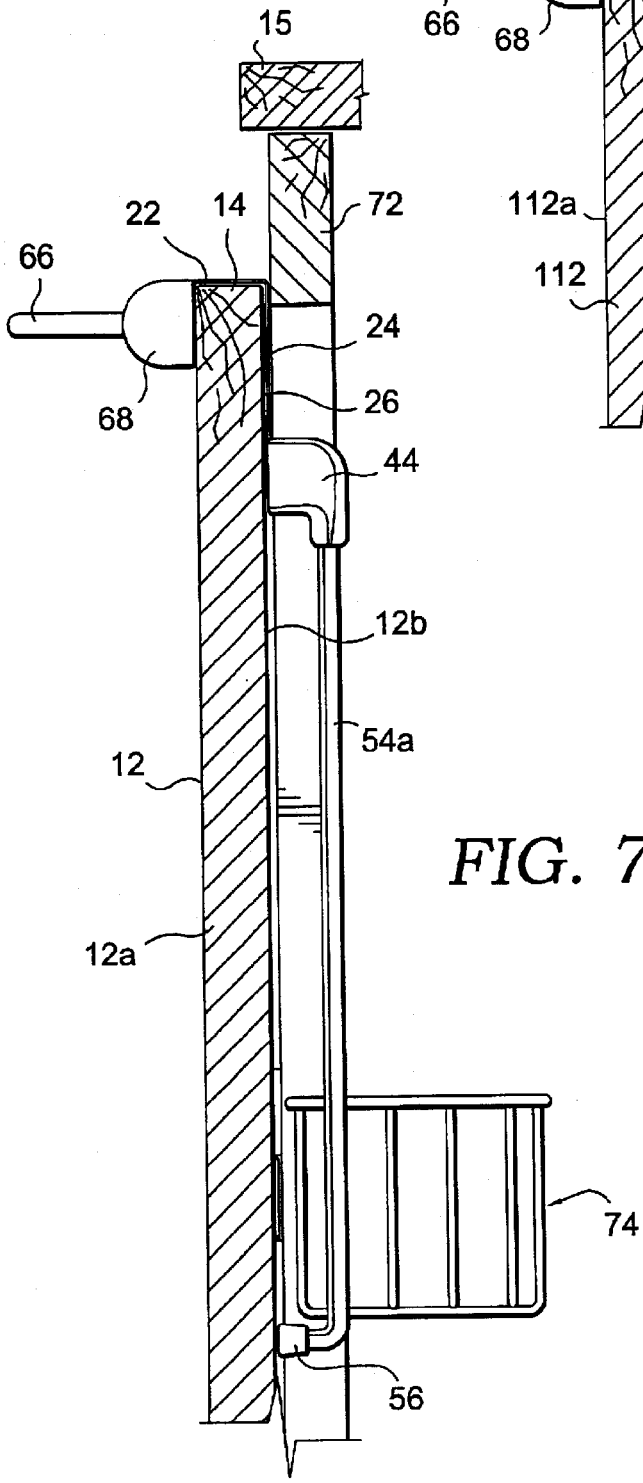
FIG. 7 is a fragmentary side elevational view showing a storage rack constructed according to another embodiment of the invention mounted on a flush cabinet door and providing a basket for the storage of articles.

Referring now to the drawings in more detail and initially to FIGS. 1-4 in particular, numeral 10 generally designates a storage rack constructed according to one embodiment of the present invention. As best shown in FIG. 1, the storage rack 10 may be mounted on a base cabinet door 12 and, more specifically, may be hung on an upper edge 14 of the door 12. The door 12 is typically hinged to the cabinet facing and may be swung to open and close a base cabinet of the type commonly found in kitchens beneath a counter top 15 (FIG. 7). The door 12 has a flat upper edge and is commonly referred to as a flush mounted cabinet door. The storage rack of the present invention may be used with base cabinets in rooms other than kitchens, including, for example, laundry rooms, bathrooms, garages and basements.

Figure 2:
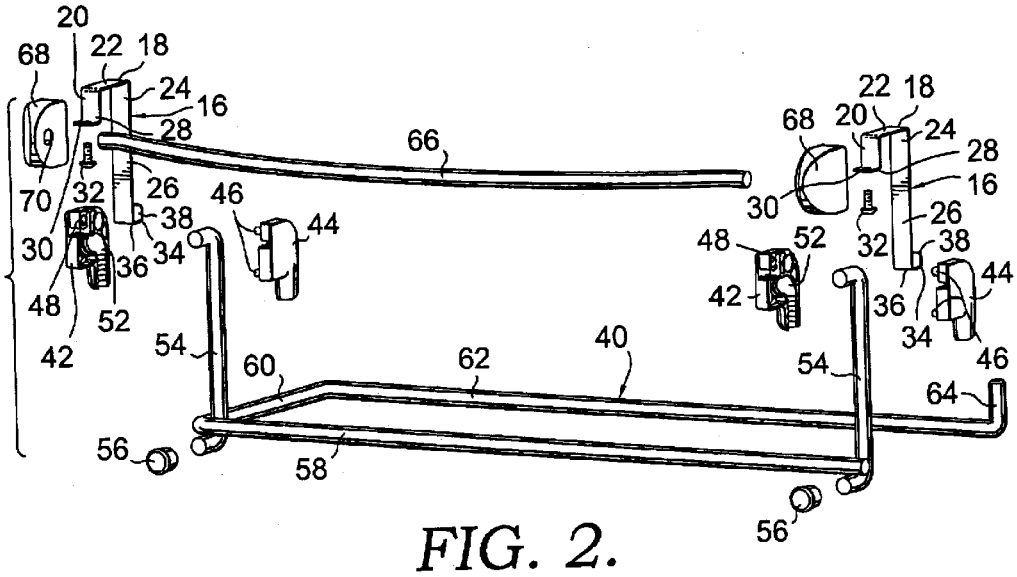
FIG. 2 is an exploded perspective view of a storage rack shown in FIG. 1.
Figure 3:
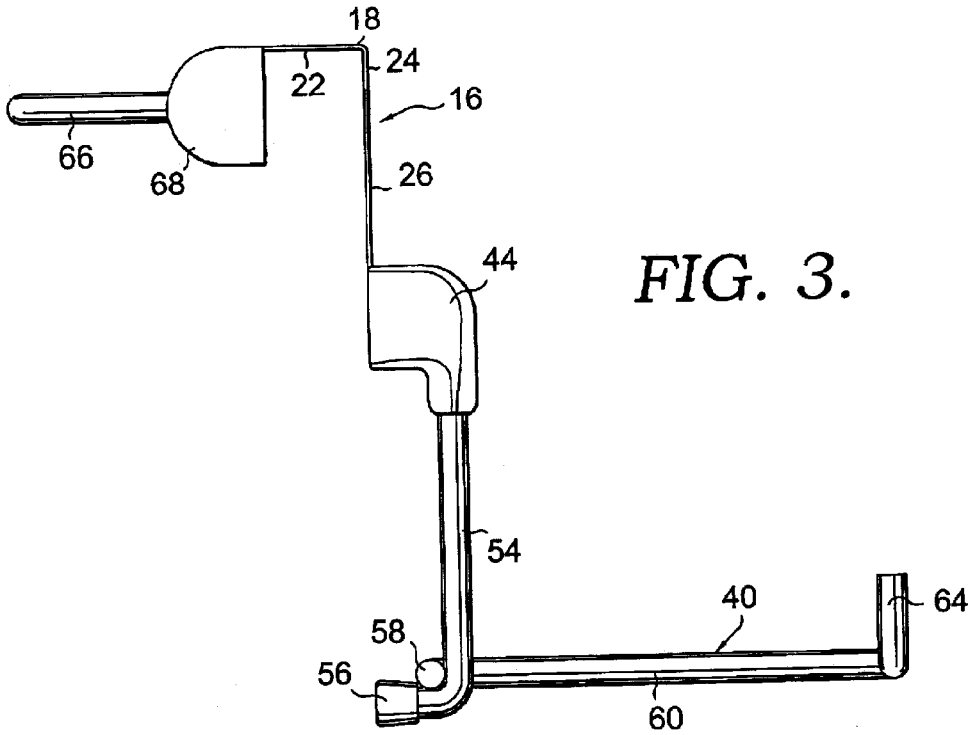
FIG. 3 is a side elevational view on an enlarged scale of the storage rack shown in FIG. 1.

The storage rack 10 includes a pair of hanger brackets which are identical to one another and generally identified by numeral 16. As best shown in FIG. 2, each of the hanger brackets 16 has a hanger portion 18 that hangs on the upper door edge 14. The hanger portion 18 has the shape of an inverted U and includes a vertical front strip 20, a horizontal flange 22 extending rearwardly from the upper edge of the front strip 20, and a back strip 24 extending downwardly from the back edge of the flange 22. A vertical leg 26 extends downwardly from the rear strip 24 and forms a downward continuation of the strip 24. As best shown in FIG. 7, each bracket 16 may be applied to the upper edge 14 of door 12 and fits closely on the upper edge of the door with the flange 22 spanning the edge 14 and fitting closely on it and the front and back strips 20 and 24 located adjacent to the outside and inside surfaces 12*a* and 12*b*, respectively, of the door 12.

With particular reference to FIG. 2, each bracket 20 preferably includes a horizontal tab 28 which projects forwardly from the lower edge of the front strip 20 and may be provided with an opening 30 for receiving a screw 32. The lower edge of the leg 26 is provided with a hook 34. Each hook 34 includes a horizontal tongue 36 which extends rearwardly from the bottom edge of leg 26 and a vertical lip 38 which extends upwardly from the back edge of the tongue 36.

Figure 4:
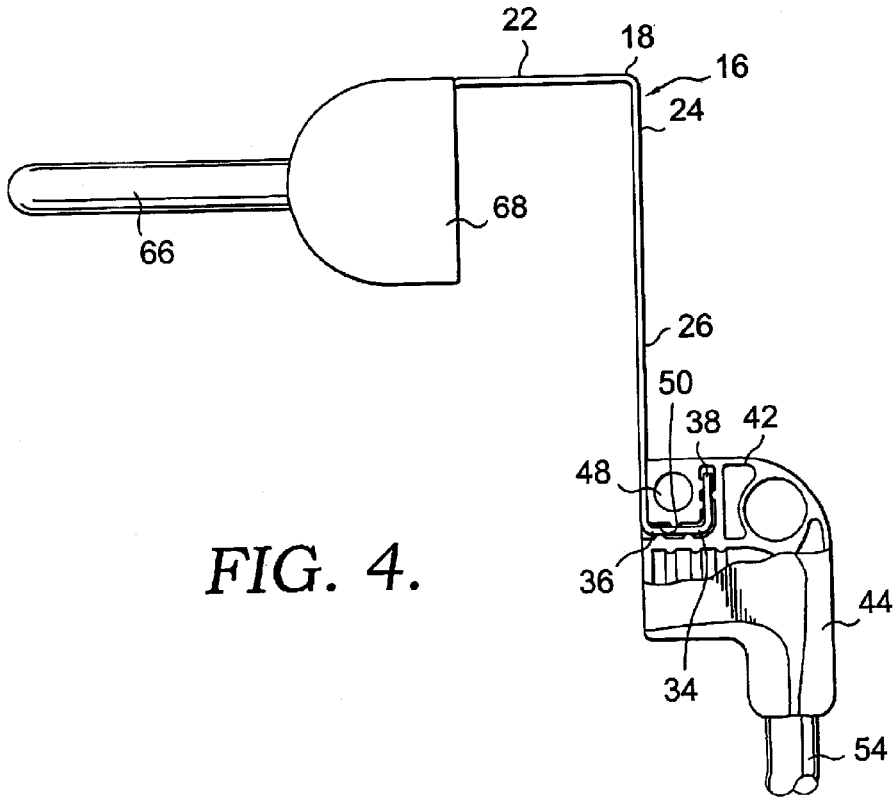
FIG. 4 is a fragmentary side elevational view of the storage rack shown in FIG. 3 on an enlarged scale with a portion of the mounting fixture broken away to illustrate the internal details.

The hooks 34 provide inner connection portions that allow various types of storage devices to be connected to the brackets 16. By way of example, a paper towel holder generally identified by numeral 40 may be connected to the brackets 16. Each bracket 16 may mount a two-piece block structure that includes a pair of mating fixtures 42 and 44. The fixtures 42 and 44 may be fitted and secured together with pins 46 projecting from fixture 44 fitting in mating sockets 48 formed in the other fixture 42 to assure alignment. The fixtures 42 and 44 may be screwed together or connected in any other suitable fashion. Alternatively, the fixtures 42 and 44 may be formed as a single unitary piece. As best shown in FIG. 4, the mating fixtures 42 and 44 cooperate to present an L-shaped passage 50 that closely receives the tongue 36 and lip 38 of hook 34 in order to secure the fixtures in place on the lower ends of the bracket legs 26. The fixtures 42 and 44 also cooperate to present an L-shaped cavity 52 (FIG. 2) in each pair of fixtures. The cavities 52 closely receive the L-shaped upper ends of generally vertical braces 54 that form parts of the paper towel holder 40. Each brace 54 has a bent upper end that fits in the cavity 52 and a bent lower end that receives a cushioned foot 56. The feet 56 fit against the inside surface 12*b* door 12, as do flat cushioned surfaces of the fixtures 42 and 44. This braces the storage rack securely against the inside surface of the door 12 while at the same time avoiding scratching or otherwise marring the door.

The paper towel holder 40 further includes a front rod 52 that extends rigidly between the two braces 54 adjacent to their lower bent ends. A short rod 60 extends rearwardly from one end of rod 58 in order to mount a horizontal rod 62 that serves to receive a roll of paper towels (not shown). The opposite end of rod 62 is provided with an upturned pin 64 that prevents the paper towel roll from inadvertently sliding off rod 62.

In this fashion, the paper towel holder 40 provides a convenient location for holding a roll of paper towels on the rod 62 at a location inside of the base cabinet near the inside surface of the door 12 and near the upper edge 14 of door 12 so that the paper towels can be easily reached by a user. Alternatively, the rod or bar that holds the paper towel roll may be oriented vertically and may be provide along with a basket or other storage device on the inside of the door 12.

The tabs 28 provide outside connection portions that may be used to mount a towel bar 66 on the outside surface of the door 12. A pair of blocks 68 are provided with sockets 70 for receiving the opposite ends of the towel bar 66 in order to locate the towel bar in extension between the blocks 68. The blocks 68 in turn may be secured to the tabs 28 by extending the screws 32 upwardly through the tab openings 30 and threading the screws into the undersides of the blocks 68. In this manner, the towel bar 66 is mounted on the outside of door 12 near its upper edge where a towel that is stored on it may be conveniently reached. The towel bar 66 is preferably bowed such that its center portion is located farther away from the outside surface of door 12 than the end portions of the towel bar. It should also be noted that the towel bar can be secured to the connecting portions provided by the tabs 28 in ways other than as disclosed for the preferred embodiment. Further, the tabs 28 can be eliminated in some applications in which there is no desire to provide a towel bar on the outside of the cabinet door 12.

As best shown in FIG. 7, the hanger brackets 16 are used with a flush mounted door 12 which has a flat, horizontal upper edge and fits flush against the base cabinet facing 72 when the door is closed as shown in FIG. 7.

FIG. 7 also shows an alternative storage device on the inside of the cabinet which takes the form of a wire basket 74. The basket 74 may be secured to braces 54*a* which may be similar to braces 54 and may connect with the fixtures 42 and 44 and may fit against the inside cabinet door surface 12*b* in the same manner described previously in connection with the paper towel holder 40. However, the braces 54*a* may be longer than braces 54 in order to locate the basket 74 at a lower position on the door closer to the cabinet floor.

The paper towel holder 40 and the basket 74 are only exemplary of the types of storage devices that can be mounted on the base cabinet door 12 in accordance with the present invention. Other examples of storage devices that can be provided include trays, shelves, paper or plastic bag holders and racks that hold articles such as dish rags and dish towels. Further, the storage device on the inside of the cabinet door may take the form of a simple hook for holding a towel or the like, and the hook may constitute either a hook similar to the hook 34 or another type of hook that is secured to hook 34 or some other connection device provided on the bracket 16 inside of the cabinet door.

Figure 5:
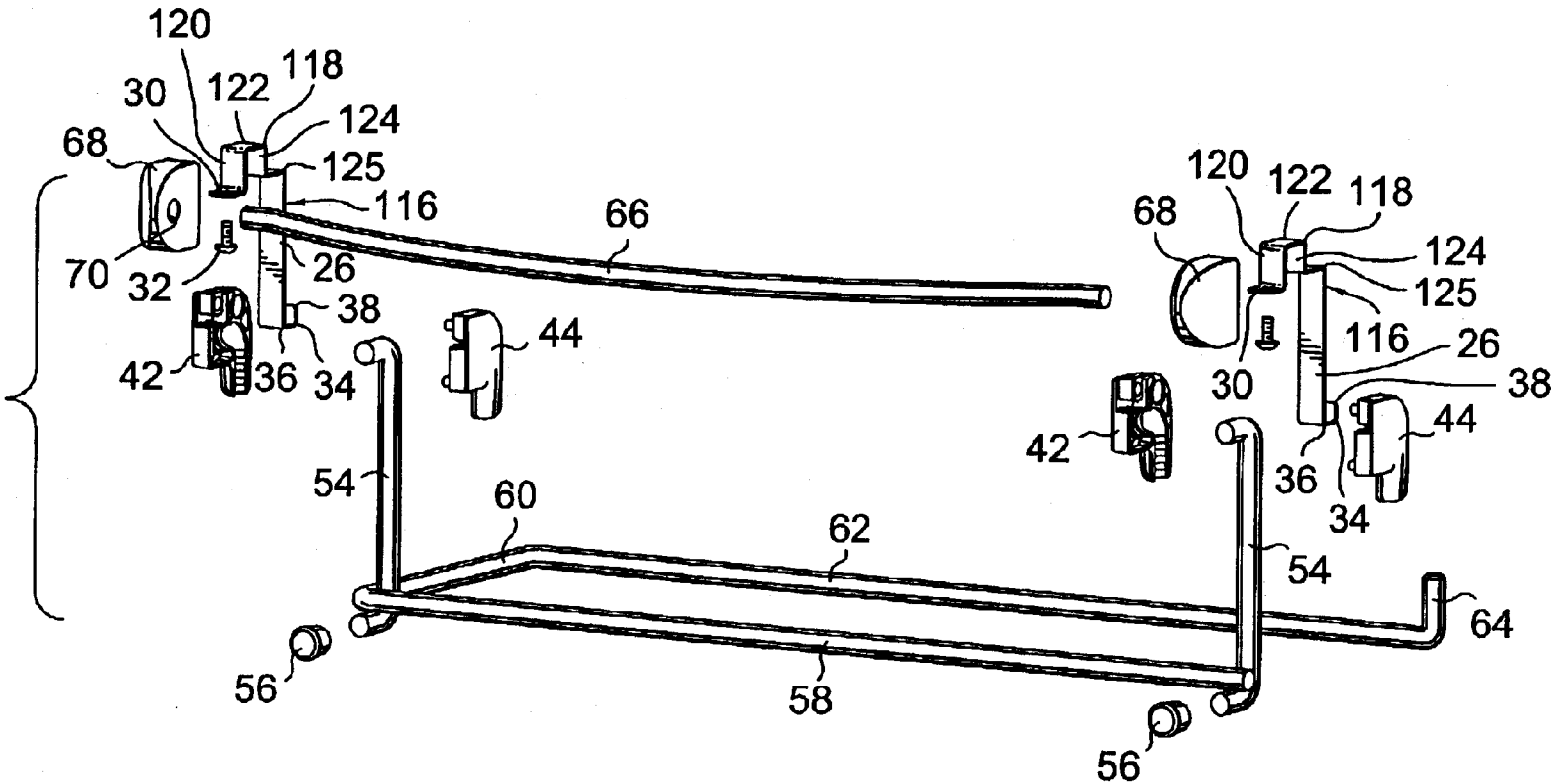
FIG. 5 is an exploded perspective view similar to FIG. 2 but showing hanger brackets constructed according to a modified embodiment of the invention for application to a recessed base cabinet door.
Figure 6:
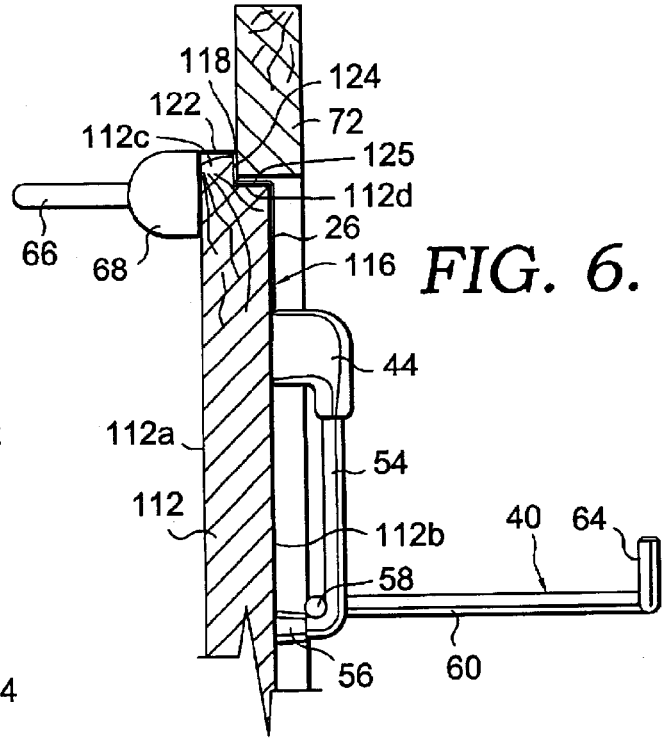
FIG. 6 is a fragmentary side elevational view showing the storage rack of FIG. 5 mounted on a recessed base cabinet door.

FIG. 5 depicts an alternative embodiment of the present invention which may be constructed identically to the embodiment previously described for the most part. However, the embodiment shown in FIG. 5 includes hanger brackets 116 that are somewhat different from the brackets 16 in order to accommodate application of the storage rack to a recessed base cabinet door. As shown in FIG. 6, a base cabinet door 112 has outside and inside surfaces 112*a* and 112*b*, respectively and a stepped upper edge that includes a lip 112*c* adjacent to the outside door surface 112*a* and a horizontal ledge 112*d* that extends rearwardly from the bottom of the lip 112*c* to the upper edge of the inside door surface 112*b*.

The brackets 116 are shaped to accommodate the stepped upper edge configuration of the recessed cabinet door 112. Accordingly, each bracket 116 has a hanger portion 118 that is in the shape of an inverted U but in which the flange 122 has a length to barely span the thickness of the lip 112*c*. The front strip 120 of the hanger portion 118 fits closely against the front surface of the lip 112*c*, and the back strip 124 fits closely against the back or inside surface of the lip 112*c*. Each bracket 116 has a horizontal shoulder 125 that is located adjacent to and on top of the ledge 112*d* when the bracket 116 is applied to the door 112. Bracket 116 has a tab 28 and a leg 26 and hook 34 that may be identical to the corresponding components of bracket 16.

The storage rack making use of the brackets 116 is applied closely to the stepped upper edge of a recessed door 112 in the manner shown in FIG. 6 and otherwise functions identically to the brackets 16 to mount various types of storage devices on the inside and/or outside of the cabinet door 112. As with brackets 16, various types of storage devices can be mounted on the brackets 116.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A storage rack for application to a door of a base cabinet that underlies a counter, said storage rack comprising:

a pair of hanger brackets applicable to an upper edge of the door, said brackets each having an inner connection portion located on the inside of the door when said brackets are applied to the upper edge of the door and an outer connection portion on the outside of the door;

a first storage device mounted on said inside connection portions of said brackets, said first storage device being constructed to receive and hold articles; and a second storage device mounted on said outer connection portions for holding articles.

2. A rack as set forth in claim 1, wherein said second storage device comprises a towel bar for holding a towel.

3. A rack as set forth in claim 1, wherein at least one of said storage devices is selected from the group consisting of a shelf, a tray and a basket.

4. A rack as set forth in claim 1, wherein said first storage device comprises a paper towel holder.

5. A rack as set forth in claim 1, wherein said first storage device comprises a towel rack.

6. A rack as set forth in claim 1, wherein said first storage device comprises a bag holder.

7. A rack as set forth in claim 1, wherein said first storage device presents at least one hook.

8. A rack as set forth in claim 1, wherein each bracket comprises:

a hanger portion having the general shape of an inverted U for hanging on the upper edge of the door;

a leg extending generally downwardly from said hanger portion along an inside surface of the door; and a hook on the lower end of said leg providing said inner connection portion of said bracket.

9. A rack as set forth in claim 8, including a mounting fixture mounted on each of said hooks, said first storage device being attached to said mounting fixtures.

10. A rack as set forth in claim 8, wherein said door is a recessed door having a stepped upper edge and said hanger portion includes:

an inverted U-shaped section; and a substantially horizontal shoulder extending between said section and said leg.

11. A rack as set forth in claim 10, wherein each bracket includes a tab element projecting from said section on the outside of the door to provide said outer connection portions, said tab elements being arranged to mount a towel bar on the outside of the door.

12. A rack as set forth in claim 8, wherein each bracket includes a tab element projecting from said hanger portion on the outside of the door to provide said outer connection portions, said tab elements being arranged to mount a towel bar on the outside of the door.

13. In combination with a hinged door of a base cabinet that underlies a counter, said door having an upper edge, the improvement comprising:

a pair of hanger brackets hanging on said upper edge of the door at spaced apart locations, each of said brackets having an inner connection portion on the inside of the door and an outer connection portion on the outside of the door;

a storage rack mounted on said inner connection portions of the brackets for receiving and holding articles; and a towel bar mounted on said outer connection portions.

14. The improvement of claim 13, wherein each bracket comprises:

a hanger portion having the general shape of an inverted U for hanging on the upper edge of the door;

a leg extending generally downwardly from said hanger portion along an inside surface of the door; and a hook on the lower end of said leg providing said inner connection portion of said bracket.

15. In combination with a hinged door of a base cabinet that underlies a counter, said door having a stepped upper edge presenting a lip and a generally horizontal ledge extending from said lip to an inside surface of the door, the improvement comprising:

a pair of hanger brackets each having an inverted U-shaped section applicable to said lip and a generally horizontal shoulder applicable to said ledge to hang said brackets on said upper edge of the door, each bracket having an inner connection portion adjacent to said inside surface of the door; and a storage rack mounted on said inner connection portions of the brackets for receiving and holding articles.

16. The improvement of claim 15, wherein each bracket includes:

a leg extending downwardly from said shoulder generally along the inside surface of the door; and a hook on the lower end of each leg providing said inner connection portions.

17. The improvement of claim 15, including:

an outer connection portion on each bracket adjacent an outside surface of the door; and a towel bar mounted on said outer connection portions.

18. A storage rack for application to a recessed cabinet door having a stepped upper edge, said storage rack comprising:

a pair of hanger brackets applicable to an upper edge of the door, said brackets each having a hanger portion that includes an inverted U-shaped section for application to the upper edge of the door and a substantially horizontal shoulder extending from said section;

a leg extending generally downwardly from said shoulder and providing a connection portion on the inside of the door; and a storage device mounted on said connecting portions, said storage device being constructed to receive and hold articles.

19. A storage rack for application to a door of a base cabinet that underlies a counter, said storage rack comprising:

a pair of hanger brackets applicable to an upper edge of the door, said brackets each having a hanger portion having the general shape of an inverted U for hanging on the upper edge of the door and a leg extending downwardly from said hanger portion along an inside surface of the door;

a storage device mounted on said legs, said storage device being constructed to receive and hold articles; and a tab element on each bracket projecting from said hanger portion on the outside of the door, said tab elements being arranged to mount a towel bar on the outside of the door.

20. In combination with a hinged door of a base cabinet that underlies a counter, said door having an upper edge, the improvement comprising:

a pair of hanger brackets hanging on said upper edge of the door at spaced apart locations, each of said brackets comprising a hanger portion having the general shape of an inverted U for hanging on the upper edge of the door and a leg extending generally downwardly along an inside surface of the door, each of said brackets further comprising a hook on the lower end of said leg providing an inner connection portion on the inside of the door; and a storage rack mounted on said inner connection portions for receiving and holding articles.

* * * * *